US010998608B2

(12) United States Patent
Shao

(10) Patent No.: US 10,998,608 B2
(45) Date of Patent: May 4, 2021

(54) HOME TELEVISION ANTENNA WITH DETACHABLE BRACKET

(71) Applicant: Shenzhen BITECA Electron Co., Ltd., Guangdong (CN)

(72) Inventor: Jihua Shao, Guangdong (CN)

(73) Assignee: Shenzhen BITECA Electron Co., Ltd., Shenzhen (CN)

( * ) Notice: Subject to any disclaimer, the term of this patent is extended or adjusted under 35 U.S.C. 154(b) by 33 days.

(21) Appl. No.: 16/671,172

(22) Filed: Nov. 1, 2019

(65) Prior Publication Data

US 2021/0083358 A1 Mar. 18, 2021

(30) Foreign Application Priority Data

Sep. 17, 2019 (CN) ..... 201921550440.9

(51) Int. Cl.
*H01Q 1/12* (2006.01)
*H01Q 1/22* (2006.01)

(52) U.S. Cl.
CPC ..... *H01Q 1/1221* (2013.01); *H01Q 1/22* (2013.01)

(58) Field of Classification Search
CPC ..... H01Q 1/12; H01Q 1/1221; H01Q 1/22
See application file for complete search history.

(56) References Cited

U.S. PATENT DOCUMENTS

2014/0043205 A1* 2/2014 Lam ..... H01Q 1/08 343/872
2016/0141791 A1* 5/2016 Wang ..... H01R 4/02 439/501
2017/0033463 A1* 2/2017 Tinaphong ..... H01Q 9/285

FOREIGN PATENT DOCUMENTS

CN 201215825 Y 4/2009

* cited by examiner

*Primary Examiner* — Hoang V Nguyen

(57) ABSTRACT

A home television antenna with a detachable bracket includes a casing, an antenna mainboard and a bracket. The antenna mainboard is disposed inside the casing and connected to a transmission line, and the transmission line extends to the exterior of the casing. The bracket is detachably connected to the casing for supporting the casing. By setting a bracket structure, the home television antenna can be supported and placed on the desktop to avoid impacts on signal transmission while being hung on a wall, and the antenna is conveniently placed on any plane without the need of construction on the wall for fixing the television antenna. The detachable connection between the bracket and the casing facilitates installation and disassembly, and it's convenient for transportation as the volume is reduced after the disassembly and it is convenient to install when the use is needed.

8 Claims, 12 Drawing Sheets

HOME TELEVISION ANTENNA WITH DETACHABLE BRACKET

CROSS REFERENCE TO RELATED APPLICATIONS

The present application claims the benefit of Chinese Utility Model Application No. 201921550440.9 filed on Sep. 17, 2019, the contents of which are incorporated herein by reference in their entirety.

TECHNICAL FIELD

The present application belongs to the field of antennas, in particular to a home television antenna with a detachable bracket.

BACKGROUND ART

An antenna is a transducer that transforms a guided wave propagating on a transmission line into an electromagnetic wave propagating in an unbounded medium (usually free space), or vice versa. The signal reception of a television needs to be done by means of the antenna.

However, the existing television antenna is generally hung on a wall, but being close to the wall would affect a signal transmission, and in some places where it is not convenient to hammer a nail into the wall, it is not convenient to install the television antenna, which affects the usage.

In the utility model application No. CN200820102737.4, disclosed is a wall-mounted wireless television signal transmitting antenna, comprising a bottom substrate located on the wall and a flat type wireless television signal transmitting antenna located on the substrate, the flat type wireless television signal transmitting antenna being provided with a cable connector. The antenna is fixedly mounted on the wall as a wall-mounted ornament.

However, the wall-mounted wireless television signal transmitting antenna disclosed in this application is installed on the wall, and the wall as an obstruction affects the signal transmission, and in some places where it is inconvenient to construct on the wall, it is not easy to install the television antenna, which affects the usage.

SUMMARY

To solve the above problems, the primary object of the present application is to provide a home television antenna with a detachable bracket, which has a detachable bracket structure for supporting the home television antenna placed on a desktop, so as to avoid impacts on the signal transmission while being hung on the wall, and the television antenna may be conveniently placed on any plane without the need of construction on the wall for fixing the television antenna.

To achieve the above object, the technical solution of the present application is as follows:

Provided in the present application is a home television antenna with a detachable bracket, which comprises a casing, an antenna mainboard and the bracket. The antenna mainboard is disposed inside the casing and connected with a transmission line, and the transmission line extends to the exterior of the casing. The bracket is detachably connected to the casing for supporting the casing. In the present application, by setting a bracket structure, the home television antenna can be supported and placed on the desktop to avoid impacts on signal transmission while being hung on the wall, and the television antenna is conveniently placed on any plane without construction on the wall for fixing the television antenna. The detachable connection between the bracket and the casing facilitates installation and disassembly, and it's convenient for transportation as the volume is reduced after the disassembly and it is convenient to install when the use is needed. The bracket and the casing can be separately produced, thus reducing the processing difficulty.

Further, in one embodiment, the bracket is detachably connected to the bottom of the casing, the top of the bracket is provided with fixing holes, limiting posts adapted to the fixing holes are provided on the bottom of the casing, the center part of the limiting post has a through groove, the bottom of the limiting post is provided with a fixing head, the end of the fixing head connecting to the limiting post is larger than the other end of the fixing head. In the present application, the detachable connection between the bracket and the casing is realized by fastening the limiting post in the fixing hole, and the settings of the through groove and the fixing head enables the limiting post which is pressed to two sides of the through groove is pressed inward to form a slight elastic deformation when the limiting post is put into the fixing hole, so that the larger end of the fixing head can be fastened in the fixing hole, thereby achieving the detachable connection between the bracket and the casing.

Further, in another embodiment, the bracket is detachably connected to one side of the casing, and an fixed angle is formed between the bracket and the casing so as to support the casing, the upper part of the bracket is provided with a fixing clamp plate, and the side of the casing is provided with a limiting groove adapted to the fixing clamp plate, the lower part of the bracket extends to form branch portions on two sides, a spacing is formed between the branch portions on two sides of the lower parts of the bracket, and the width of the branch portions on the two sides of the lower part of the bracket gradually increases from top to bottom. In the present application, the bracket is detachably connected to one side of the casing by fastening the fixing clamp plate in the limiting groove, and installation and disassembly of the bracket and the casing can be facilitated by the settings of the fixing clamp plate and the limiting groove, and the support and the placement of the home television antenna is facilitated. As the lower part of the bracket extends to form branch portions on two sides, the casing can be more stably supported on a plane by the bracket.

Further, the upper part and the lower part of the bracket are both arc-shaped structures, the bend directions of arc-shaped structures of the upper part and the lower part of the bracket are opposite to each other, and the angle between the bracket and the casing is an acute angle. In the present application, the support and placement of the home television antenna can be more facilitated by the setting of the above structures.

Further, the casing comprises an upper casing and a lower casing, the upper casing and the lower casing are fixedly connected and enclose to form a limiting space. In the present application, with the setting of the limiting space, the position of the antenna mainboard can be conveniently limited in the limiting space between the upper casing and the lower casing.

Further, the antenna mainboard is provided with first screw holes, first fixing posts are provided on locations inside the lower casing and opposite to the first screw holes; the lower casing is provided with second screw holes, second fixing posts are provided on locations inside the upper casing and opposite to the second screw holes, and each of the first fixing posts and the second fixing posts is provided with a thread groove. In the present application, the screws pass through the first screw holes and are fixed in the thread grooves of the first fixing posts via rotation, thereby fixing the antenna mainboard inside the lower casing, and then the screws pass through the second screw holes of the lower casing and are fixed in the thread grooves of the second fixing posts via rotation, so that the upper casing and the lower casing are fixedly connected, and the antenna mainboard is fixed between the upper casing and the lower casing, thus the structure of the home television antenna is stable after installation.

Further, the number of the first screw holes and the number of the first fixing posts are both four, the number of the second screw holes and the number of the second fixing posts are both six, the six second screw holes are respectively formed on two sides of upper part, two sides of middle part and two sides of lower part of the lower casing, and the second screw holes on two sides of the lower casing are symmetrically arranged, and the six second fixing posts are respectively integrally formed on two sides of upper part, two sides of middle part and two sides of lower part of a surface of the upper casing facing the lower casing, the second fixing posts on two sides of the upper casing correspond to the second screw holes in terms of positions and are symmetrically arranged with each other, the four first screw holes are respectively provided on two sides of upper part and two sides of lower part of the antenna mainboard, and the first screw holes on the two sides of the antenna mainboard are symmetrically arranged with each other, the four first fixing posts correspond to the first screw holes in terms of positions and are between the second screw holes on the upper part and the lower part of the lower casing; and, two sides of middle part of the antenna mainboard are further provided with third screw holes corresponding to the positions of the second screw holes on two sides of the middle part of the lower casing. In the present application, four screws pass through the first screw holes and are fixed in the thread grooves of the first fixing posts via rotation, thereby fixing the antenna mainboard inside the lower casing, and then six screws pass through the second screw holes of the lower casing and are fixed to the thread grooves of the second fixing posts via rotation, wherein the two screws in the middle part further pass through the third screw holes of the antenna mainboard and are fixed in the threw grooves of the second fixing posts in the middle part of the upper casing, whereby the upper casing and the lower casing are fixedly connected so that the antenna mainboard is fixed between the upper casing and the lower casing. With the settings of the amount and location the first screw holes, the first fixing posts, the second screw holes, the second fixing posts and the third screw holes, the connections among the upper casing, the lower casing and the antenna mainboard can be more stable.

Further, horizontal positioning plates and vertical positioning plates are both disposed inside the upper casing and the lower casing, the horizontal positioning plates and the vertical positioning plates are placed cross each other to form a grid structure, and the horizontal positioning plates and the vertical positioning plates of the upper casing correspond to the horizontal positioning plates and the vertical positioning plates of the lower casing in terms of positions to form the limiting space. In the present application, by the settings of the horizontal positioning plates and the vertical positioning plates, the position where the antenna mainboard should be fixed can be more clearly located, and the fixed connections among the upper casing, the lower casing and the antenna mainboard are facilitated.

Further, the number of the horizontal positioning plates of the upper casing and the number of the horizontal positioning plates of the lower casing are both more than three, the number of the vertical positioning plates of the upper casing and the number of the vertical positioning plates of the lower casing are both more than three, the more than three horizontal positioning plates of the upper casing and the lower casing have equal spacing among each other, the more than three vertical positioning plates of the upper casing and the lower casing have equal spacing among each other, three horizontal positioning plates in the upper casing and the lower casing are respectively horizontally provided in the upper end, middle end and lower end inside the upper casing and the lower casing, and, three vertical positioning plates in the upper casing and the lower casing are respectively vertically provided in the left end, middle end and right end inside the upper casing and the lower casing. In the present application, by the settings of the amount and position of the horizontal positioning plates and the vertical positioning plates, the position where the antenna mainboard should be fixed can be clearly located, and the fixed connections among the upper casing, the lower casing and the antenna mainboard are facilitated.

Further, the lower part of the lower casing is further provided with a wiring hole and a wiring plate, the wiring plate being located on one side of the wiring hole, the wiring plate is perpendicular to the inner wall of the lower casing, and the wiring plate is further provided with a wiring slot. In the present application, the transmission line connected to the antenna mainboard can be guided through the wiring slot and then pass through the wiring hole to the outside of the casing. The position of the transmission line of the antenna mainboard corresponds to the position of the wiring hole, and the transmission line can directly pass through the wiring hole without the wiring slot.

Further, the outer wall of the lower casing is further provided with a fixing member, and the fixing member is provided with fixing clamp grooves. In the present application, the number of fixing clamp grooves can be set to two, and the fixing clamp grooves are respectively formed on the left and right sides of the fixing member, and can also be fixed on the wall through the fixing clamp grooves when necessary, and the application range is wider.

Further, the home television antenna with the detachable bracket further comprises an antenna amplifying means electrically connected to the transmission line; and, a circuit module is disposed in the antenna amplifying means; the circuit means comprises a power interface, a power switch, a control switch, a control chip, a signal input terminal, a signal output terminal, a first capacitor, a second capacitor, a third capacitor, a fourth capacitor, a fifth capacitor, a sixth capacitor, a seventh capacitor, an eighth capacitor, a first resistor, a second resistor, a third resistor, a fourth resistor, a fifth resistor, a sixth resistor, a first inductor, a second inductor, a third inductor, a first light emitting diode and a second light emitting diode, wherein the signal input terminal is electrically connected to the antenna mainboard through the transmission line, the power switch and the control switch are both provided with EQ terminals and FULL terminals, the control chip comprises four pins, the specific model number of the control chip is Infineon BFP420;

The power interface is connected to the input terminal of the power switch; when the power switch switches to the FULL terminal, one terminal of the first resistor is connected to the power switch, and the other terminal of the first resistor is connected to the anode of the first light emitting diode, while the cathode of the first light emitting diode is grounded; in the present application, the circuit is connected to an external power supply through the power interface, and after the +5V power supply is introduced into the circuit, if the power switch switches to the FULL terminal, the first light emitting diode is on and the circuit is in a neutral state at this time, which may protect the circuit, maintain its static function, prevent the circuit from working for a long time, and prolong the lifetime of the circuit;

when the power switch switches to the EQ terminal, one terminal of the second resistor is connected to the power switch, and the other terminal of the second resistor is connected to one terminal of the first inductor, and the other terminal of the first inductor is connected to one terminal of the fourth resistor, while the other terminal of the fourth resistor is connected to the anode of the second light emitting diode, and the cathode of the second light emitting diode is grounded; and, one terminal of the first capacitor is connected to the common terminal of the second resistor and the first inductor, the other terminal of the first capacitor is grounded, one terminal of the second capacitor and one terminal of the third capacitor are both connected to the common terminal of the first inductor and the fourth resistor, and the other terminals of the second capacitor and the third capacitor are both grounded; in the present application, if the power switch switches to the EQ terminal, the +5V power supply passes through the second resistor, the first inductor, and the fourth resistor, and then the second light emitting diode is on, during which the first capacitor, the second capacitor, and the third capacitor act as a filter to ensure the safe grounding of the circuit;

one terminal of the third resistor is connected to the common terminal of the first inductor and the fourth resistor, the other terminal of the third resistor is connected to one terminal of the second inductor, the other terminal of the second inductor is connected to one terminal of the fifth resistor, the other terminal of the fifth resistor is connected to a first pin of the control chip, one terminal of the sixth resistor is connected to the common terminal of the fifth resistor and the control chip, the other terminal of the sixth resistor is connected to a third pin of the control chip, one terminal of the fourth capacitor is connected to the common end of the third resistor and the second inductor, and the other terminal of the fourth capacitor is grounded; and, a second pin and a fourth pin of the control chip are both grounded; in the present application, the power switch switches to the EQ terminal, and the +5V power supply passes through the third resistor, the second inductor, and the fifth resistor, and then achieves the first pin of the control chip, and the +5V power supply simultaneously passes through the third resistor, the second inductor, the fifth resistor and the sixth resistor, and then achieves the third pin of the control chip.

One terminal of the fifth capacitor is connected to the first pin of the control chip, the other terminal of the fifth capacitor is connected to the signal input terminal, the signal input terminal is further connected with one terminal of the sixth capacitor, and the other terminal of the sixth capacitor is connected to the FULL terminal of the control switch, and the signal output terminal is connected to the control switch; in the present application, when the power switch switches to the EQ terminal, if the control switch switches to the FULL terminal, a television signal input from the signal input terminal is filtered by the six capacitor and flows to the signal output terminal which directly outputs the television signal to the television;

the third pin of the control chip is connected to one terminal of the seventh capacitor, the other terminal of the seventh capacitor is connected to one terminal of the eighth capacitor, and the other terminal of the eighth capacitor is connected to the EQ terminal of the control switch; and, one terminal of the third inductor is connected to the common terminal of the seventh capacitor and the eighth capacitor, and the other terminal of the third inductor is grounded; in the present application, when the power switch switches to the EQ terminal, if the control switch switches to the EQ terminal, the television signal input from the signal input terminal is amplified by the control chip, and then filtered by a filter circuit consists of the seventh capacitor, the third inductor and the eighth capacitor, after which it is output to the signal output terminal.

In the present application, through the setting of the above circuit structure, a user can conveniently select to amplify or not amplify the television signal according to the distance between the home and a base station from which the television signal is transmitted or the strength of the television signal. Firstly, it is needed to switch the power switch to the EQ terminal to connect the control chip to the power supply. When the television signal is strong, the control switch may be placed on the FULL side, and the television signal can be input stably and normally for television playback without amplification. When the television signal is weak, the control switch may be placed on the EQ side, and the television signal received by the antenna mainboard is amplified by the control chip and output from the signal output terminal, and then the television signal can be normally play. The user can flexibly choose according to his/her own condition. Compared with the technical solutions in the prior art that the signals are equally processed regardless of the signal strength, in the present application, with the setting of distinguishing the strength of the television signal wherein the stronger television signal is directly output and the weaker television signal is amplified before output, it is more reliable while the damage to the television itself is smaller, and the television signal is better.

The present application has the advantageous effects in that: compared with the prior art, in the present application, the home television antenna can be supported and placed on the desktop by the setting of the bracket structure, so as to avoid affecting the signal transmission while being hung on the wall, and the television antenna can be conveniently placed on any plane without construction on the wall for fixing the television antenna; and, the detachable connection between the bracket and the casing facilitates installation and disassembly, and it's convenient for transportation as the volume is reduced after the disassembly and it is convenient to install when the use is needed. The bracket and the casing can be separately produced, thus reducing the processing difficulty.

DETAILED DESCRIPTION

Figure 1:
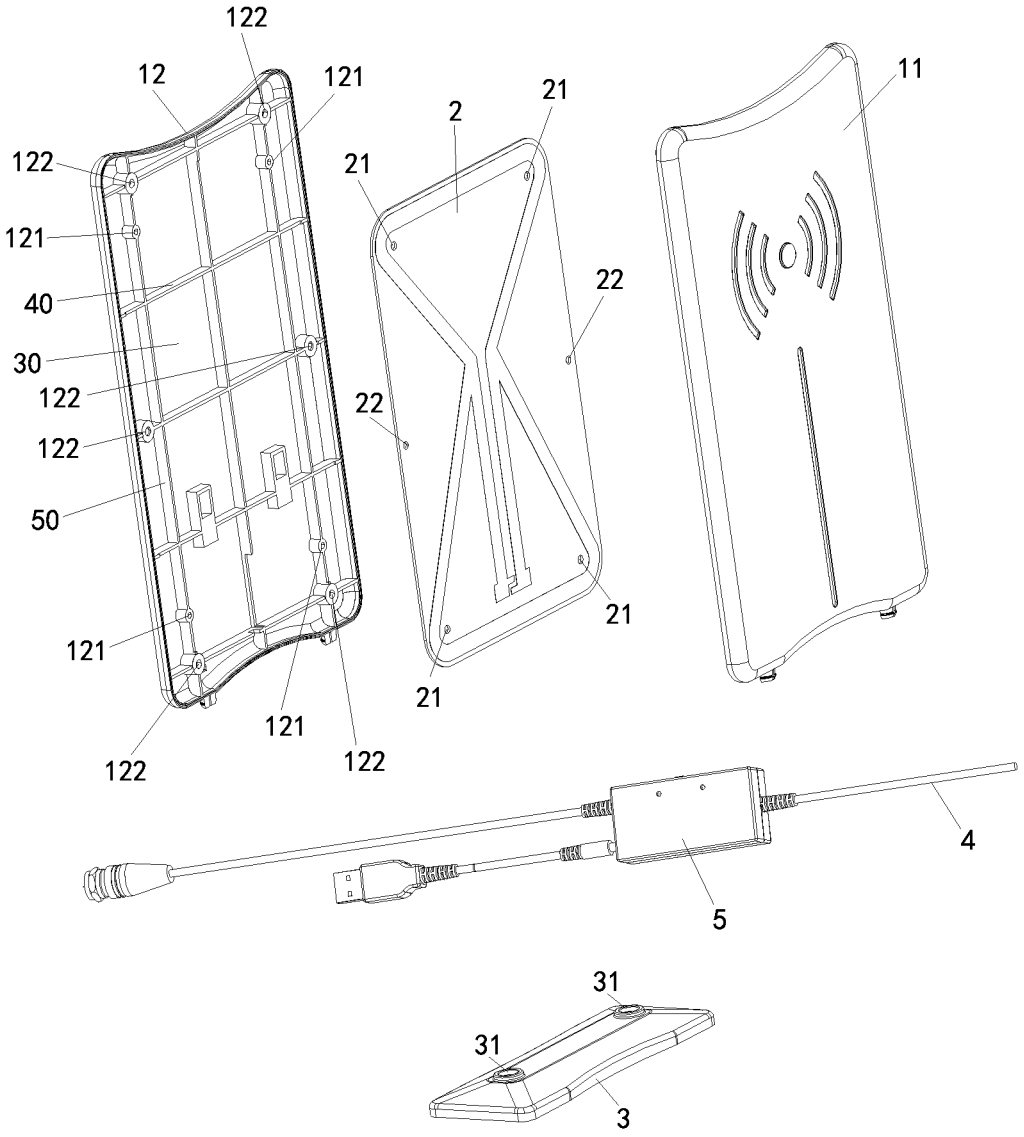
FIG. 1 is a first perspective explosion schematic diagram of a home television antenna with a detachable bracket in a first embodiment of the present application.

In order to make the objects, technical solution and advantages of the present application clearer and more comprehensible, the present application will be further described in detail below with reference to the accompanying drawings and embodiments. It is understood that the specific embodiments described herein are merely illustrative of the present application and are not intended to limit the present application.

Referring to FIGS. 1-13, the present application provides a home television antenna with a detachable bracket, comprising: a casing 1, the antenna mainboard 2 and the bracket 3, wherein the antenna mainboard 2 is provided inside the casing 1 and is connected to a transmission line 4, and the transmission line 4 extends to the outside of the casing 1. The bracket 3 is detachably connected to the casing 1 for supporting the casing 1. In the present application, by adopting the structure of the bracket 3, the home television antenna can be supported and placed on the desktop to avoid affecting signal transmission while being hung on a wall, and the television antenna is conveniently placed on any plane without the need of construction on the wall for fixing the television antenna. The detachable connection between the bracket 3 and the casing 1 facilitates installation and disassembly, and it's convenient for transportation as the volume is reduced after the disassembly and it is convenient to install when the use is needed. The bracket and the casing can be separately produced, thus reducing the processing difficulty. Referring to FIGS. 1-2 and 7-9, in one embodiment, the bracket 3 is detachably connected to the bottom of the casing 1. The top of the bracket 3 is provided with fixing holes 31, and the bottom of the casing 1 is provided with limiting posts 10 adapted to the fixing holes 31. The middle part of the limiting post 10 has a through groove 101, the bottom of the limiting post 10 is provided with a fixing head 102, and one end of the fixing head 102 which is connected to the limiting post 10 is larger than the other end of the fixing head 102. In the present application, the numbers of the fixing holes 31 and the limiting posts 10 can be set to two, and the two fixing holes 31 are respectively formed on the left and right sides of the top of the bracket, and the two limiting posts 10 are respectively disposed at right and left sides of the bottom of the casing 1. By fastening the limiting posts 10 into the fixing holes 31, the detachable connection between the bracket 3 and the casing 1 is achieved. With the settings of the through groove 101 and the fixing head 102, when the limiting post 10 is put into the fixing hole 31, the limiting post 10 which is pressed to two sides of the through groove 101 is pressed inward to form a slight elastic deformation so that the larger end of the fixing head 102 can be fastened into the fixing hole 31, thereby realizing the detachable connection between the bracket 3 and the casing 1.

Referring to FIGS. 3-6, and 10-13, in another embodiment, the bracket 3 is detachably connected to one side of the casing 1 and forms a fixed angle with respect to the casing 1, so that the casing 1 is supported. The upper part of the bracket 3 is provided with a fixing clamp plate 32. The side of the casing 1 is provided with a limiting groove 20 adapted to the fixing clamp plate 32. The lower of the bracket 3 extends to form branch portions 33 on two sides. Spacing exists between the branch portions 33 on the two sides of the lower part of the bracket. The width of the branch portions 33 on the two sides of the lower part of the bracket gradually increases from top to bottom to form a crotch-like structure. In the present application, the fixing clamp plate 32 is fastened into the limiting groove 20 so that the bracket 3 is detachably connected to one side of the casing 1. With the settings of the fixing clamp plate 32 and the limiting groove 20, it is able to facilitate the installation and disassembly of the bracket 3 and the casing 1, and the support and placement of the home television antenna is facilitated. The setting of the branch portions 33 extending from the two sides of the lower part of the bracket 2 allows the casing 1 to be more stably supported on the plane by the bracket 3.

Specifically, the upper part and lower part of the bracket 3 are both arc-shaped structures of which the bend directions are opposite to each other, and the angle between the bracket 3 and the casing 1 is an acute angle. In the present application, the support and placement of the home television antenna can be more convenient by the setting of the above structures.

Referring to FIGS. 1-6, the casing 1 comprises an upper casing 11 and a lower casing 12, and the upper casing 11 and lower casing 12 are fixedly connected and enclose to form a limiting space 30. In the present application, the setting of the limiting space 30 can facilitate the position of the antenna mainboard 2 to be limited in the limiting space 30 between the upper casing 11 and the lower casing 12.

Specifically, the antenna mainboard 2 is provided with first screw holes 21, and first fixing posts 121 are disposed at positions inside the lower casing 12 opposite to the first screw holes 21; second screw holes 122 are opened on the lower casing 12, and second fixing posts 111 are disposed at positions inside the upper casing 11 opposite to the second screw holes 122. The first fixing posts 121 and the second fixing posts 111 are respectively provided with thread grooves. In the present application, the screws pass through the first screw holes 21, and then are fixed in the thread grooves of the first fixing posts 121 via rotation, thereby fixing the antenna mainboard 2 inside the lower casing 12, and then the screws pass through the second screw holes 122 of the lower casing 12 and are fixed in the thread grooves of the second fixing posts 111, so that the upper casing 11 and the lower casing 12 are fixedly connected, thus the antenna mainboard 2 is fixed between the upper casing 11 and the lower casing 12, which makes the structure of the home television antenna after installation stable.

Figure 2:
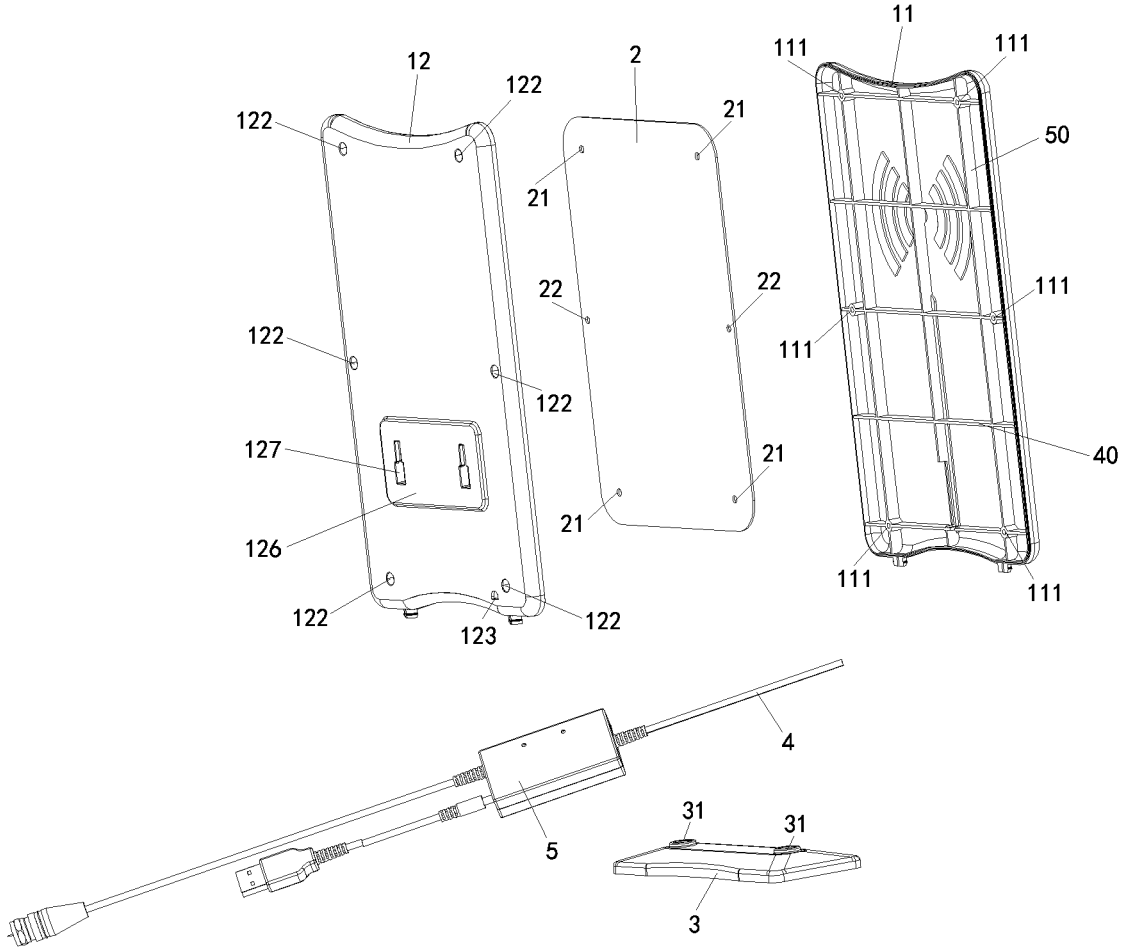
FIG. 2 is a second perspective explosion schematic diagram of the home television antenna with the detachable bracket in the first embodiment of the present application.

As shown in FIGS. 1-2, the number of the first screw holes 21 and the number of the first fixing posts 121 are both four, the number of the second screw holes 122 and the number of the second fixing posts 111 are both six, the six second screw holes 122 are respectively opened on two sides of upper part, two sides of middle part and two sides of lower part of the lower casing 12, and the second screw holes 122 on two sides of the lower casing 12 are symmetrically arranged, and the six second fixing posts 111 are respectively integrally formed on two sides of upper part, two sides of middle part and two sides of lower part of a surface of the upper casing 11 facing the lower casing 12, the second fixing posts 111 on two sides of the upper casing 11 correspond to the second screw holes 122 in terms of positions and are symmetrically arranged with each other, the four first screw holes 21 are respectively provided on two sides of upper part and two sides of lower part of the antenna mainboard 2, and the first screw holes 21 on the two sides of the antenna mainboard 2 are symmetrically arranged with each other, the four first fixing posts 121 correspond to the first screw holes 21 in terms of positions and are between the second screw holes 122 on the upper part and the lower part of the lower casing 12; and, two sides of middle part of the antenna mainboard 2 are further provided with third screw holes 22 corresponding to the positions of the second screw holes 122 on two sides of the middle part of the lower casing 12. In the present application, four screws pass through the first screw holes 21 and are fixed in the thread grooves of the first fixing posts 121 via rotation, thereby fixing the antenna mainboard 2 inside the lower casing 12, and then six screws pass through the second screw holes 122 of the lower casing 12 and are fixed to the thread grooves of the second fixing posts 111 via rotation, wherein the two screws in the middle part further pass through the third screw holes 22 of the antenna mainboard 2 and are fixed in the threw grooves of the second fixing posts 111 in the middle part of the upper casing 11, whereby the upper casing 11 and the lower casing 12 are fixedly connected so that the antenna mainboard 2 is fixed between the upper casing 11 and the lower casing 12. With the amount and location settings of the first screw holes 21, the first fixing posts 121, the second screw holes 122, the second fixing posts 111 and the third screw holes 22, the connections among the upper casing 11, the lower casing 12 and the antenna mainboard 2 can be more stable.

The settings of the position and amount of the first screw holes, the first fixing posts, the second screw holes, the second fixing posts and the third screw holes in two other embodiments may also be arranged as shown in FIGS. 3-6.

Specifically, horizontal positioning plates 40 and vertical positioning plates 50 are both disposed inside the upper casing 11 and the lower casing 12, the horizontal positioning plates 40 and the vertical positioning plates 50 are placed cross each other to form a grid structure, and the horizontal positioning plates 40 and the vertical positioning plates 50 of the upper casing 11 correspond to the horizontal positioning plates 40 and the vertical positioning plates 50 of the lower casing 12 in terms of positions to enclose and form the limiting space 30. In the present application, by the settings of the horizontal positioning plates 40 and the vertical positioning plates 50, the position where the antenna mainboard 2 should be fixed can be more clearly located, and the fixed connections among the upper casing 11, the lower casing 12 and the antenna mainboard 2 are facilitated.

Specifically, the number of the horizontal positioning plates 40 of the upper casing 11 and the number of the horizontal positioning plates 40 of the lower casing 12 are both more than three, the number of the vertical positioning plates 50 of the upper casing 11 and the number of the vertical positioning plates 50 of the lower casing 12 are both more than three, the more than three horizontal positioning plates 40 of the upper casing 11 and the lower casing 12 have equal spacing among each other, the more than three vertical positioning plates 50 of the upper casing 11 and the lower casing 12 have equal spacing among each other, three horizontal positioning plates 40 in the upper casing 11 and the lower casing 12 are respectively horizontally provided in the upper end, middle end and lower end inside the upper casing 11 and the lower casing 12, and, three vertical positioning plates 50 in the upper casing 11 and the lower casing 12 are respectively vertically provided in the left end, middle end and right end inside the upper casing 11 and the lower casing 12. In the present application, by the amount and position settings of the horizontal positioning plates 40 and the vertical positioning plates 50, the position where the antenna mainboard 2 should be fixed can be clearly located, and the fixed connections among the upper casing 11, the lower casing 12 and the antenna mainboard 2 are facilitated.

Figure 3:
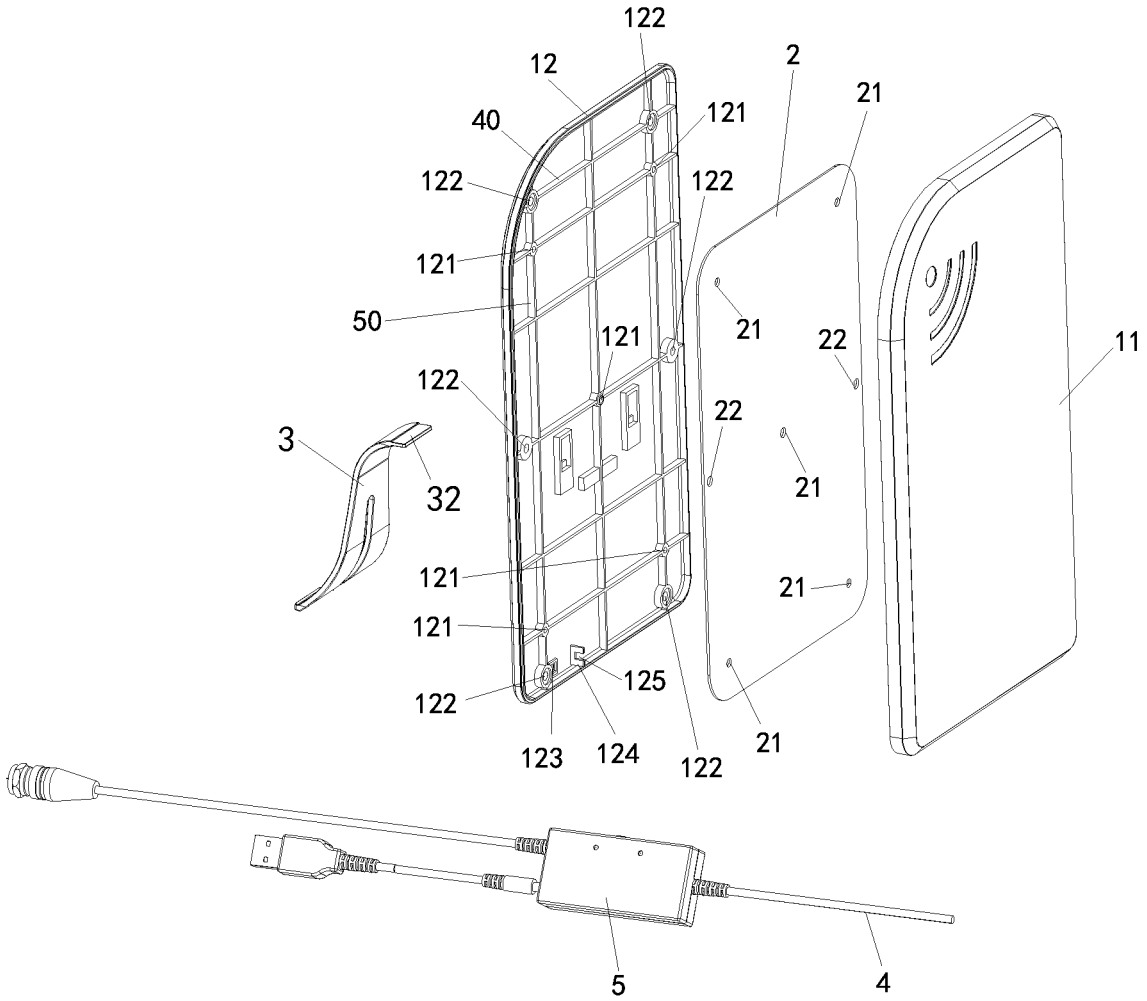
FIG. 3 is a first perspective explosion schematic diagram of a home television antenna with a detachable bracket in a second embodiment of the present application.
Figure 4:
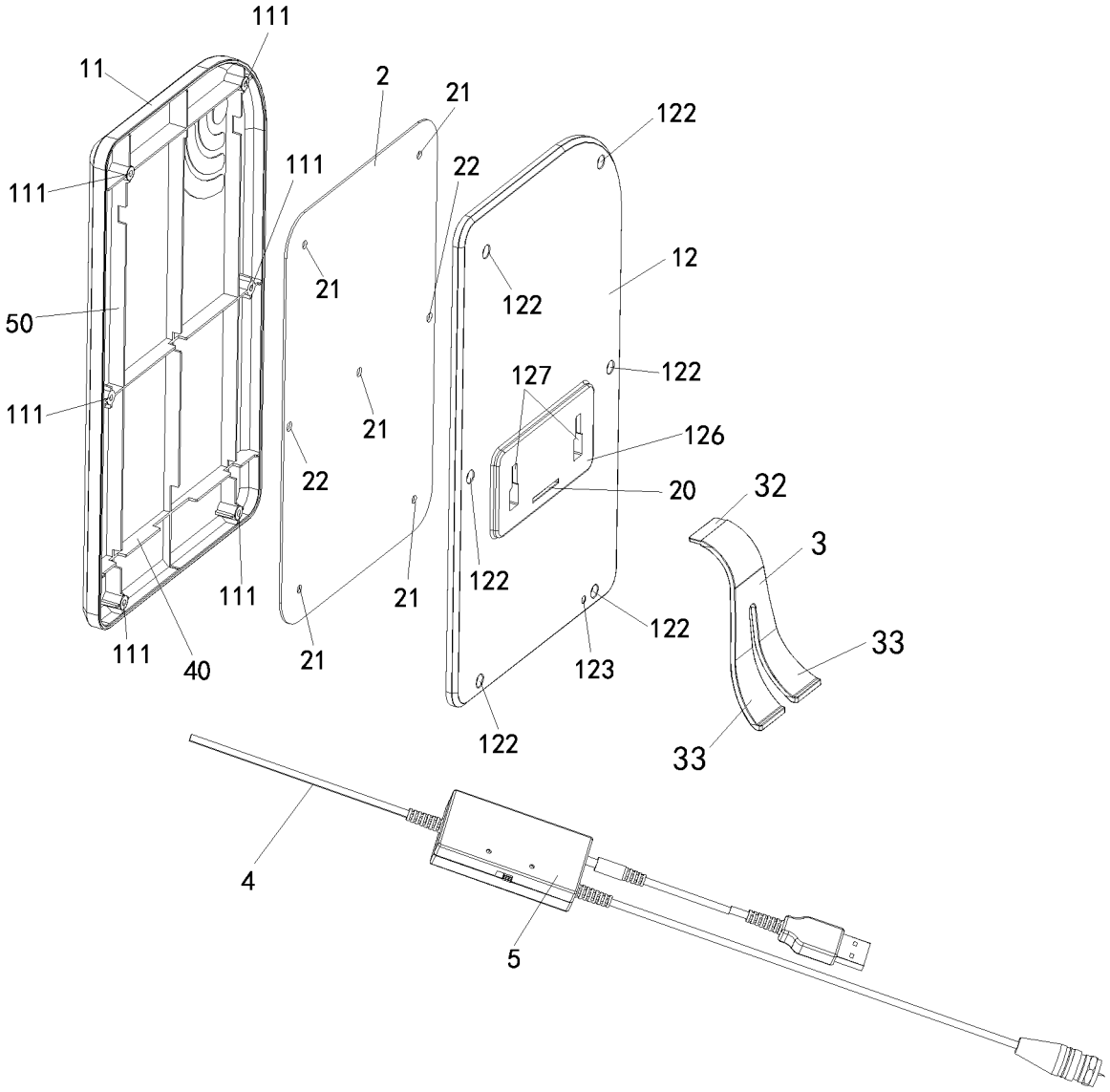
FIG. 4 is a second perspective explosion schematic diagram of the home television antenna with the detachable bracket in the second embodiment of the present application.
Figure 5:
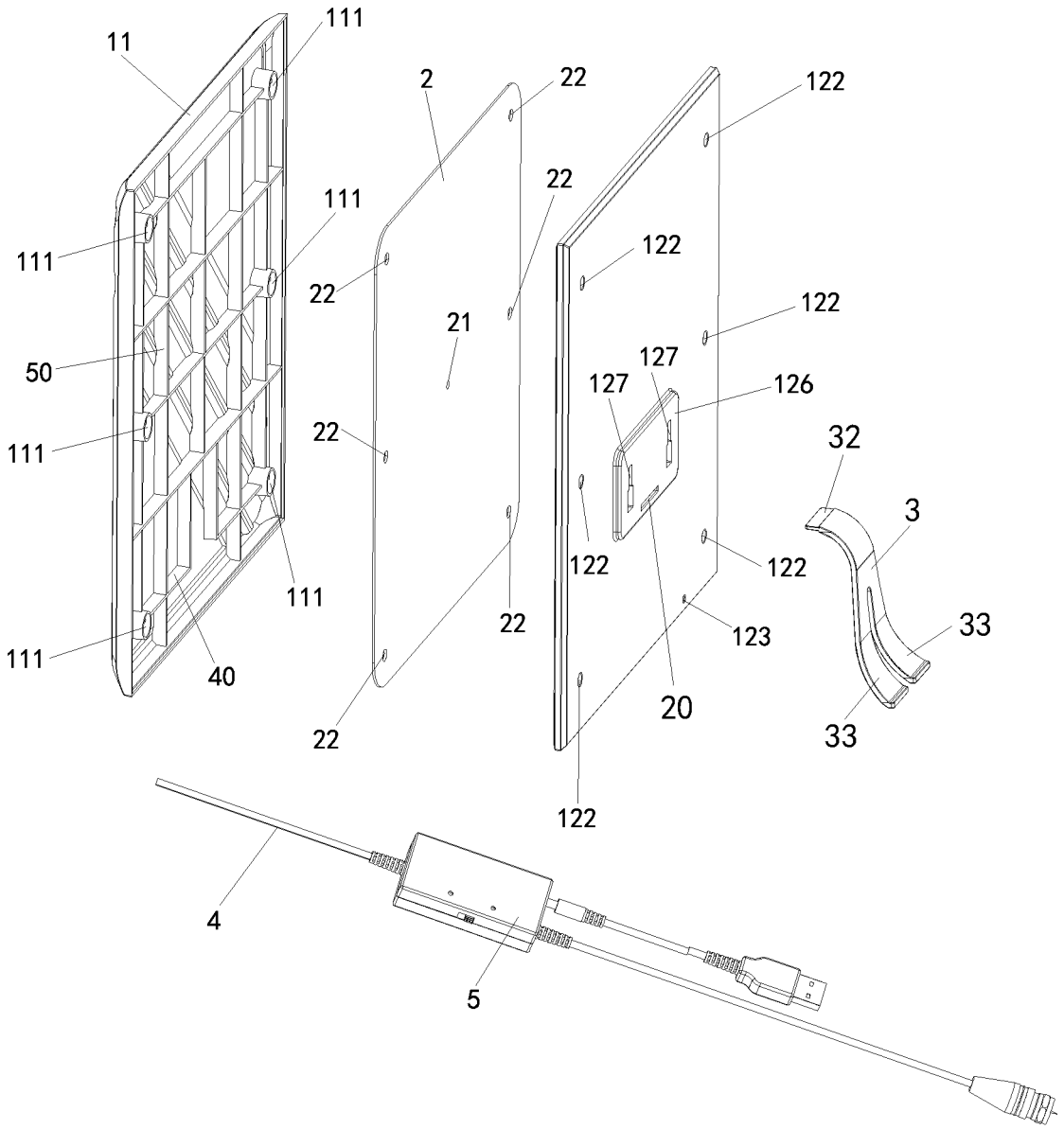
FIG. 5 is a first perspective explosion schematic diagram of a home television antenna with a detachable bracket in a third embodiment of the present application.
Figure 6:
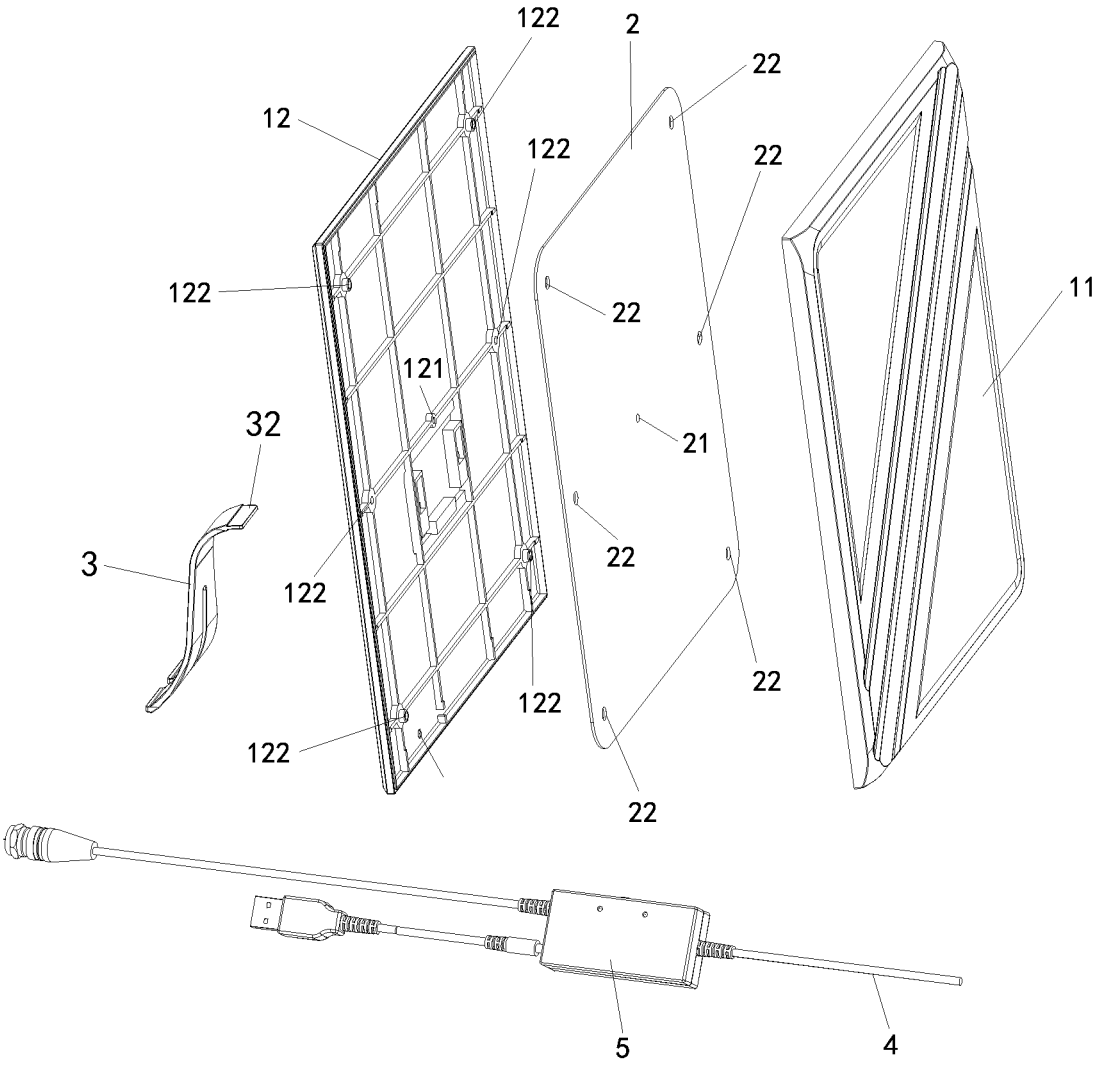
FIG. 6 is a second perspective explosion schematic diagram of the home television antenna with the detachable bracket in the third embodiment of the present application.
Figure 7:
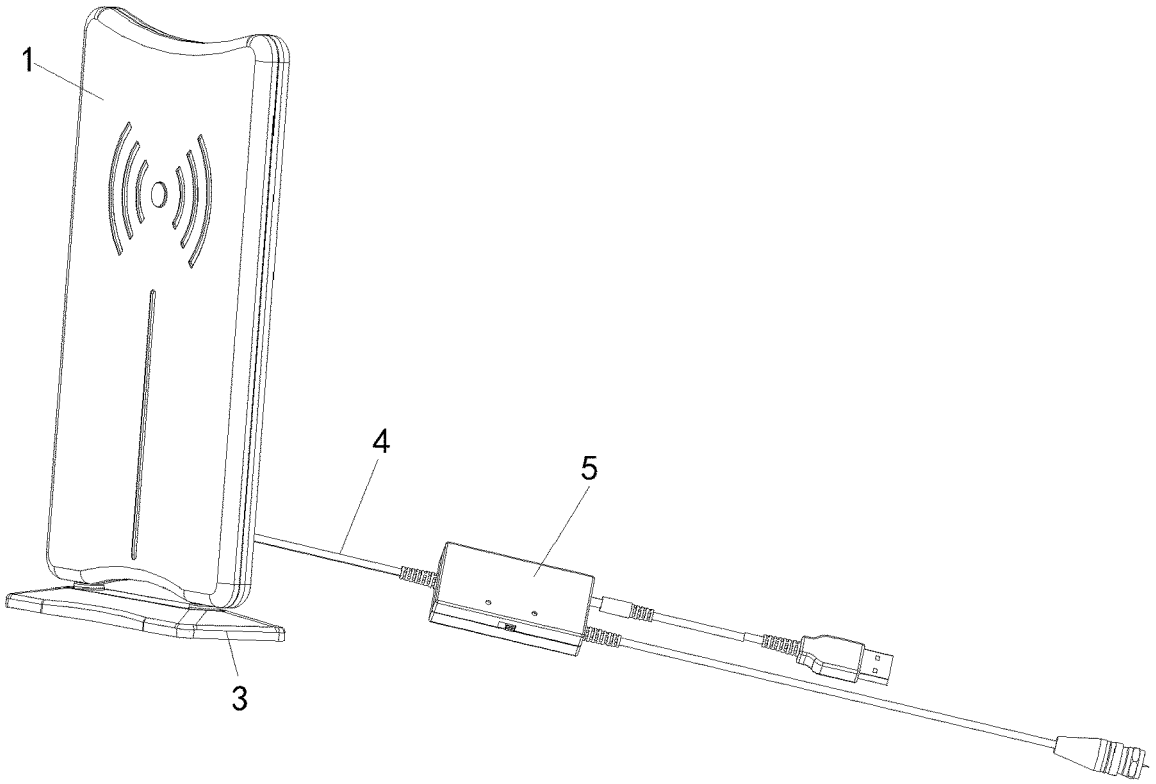
FIG. 7 is a structural schematic diagram of the home television antenna with the detachable bracket in the first embodiment of the present application.
Figure 8:
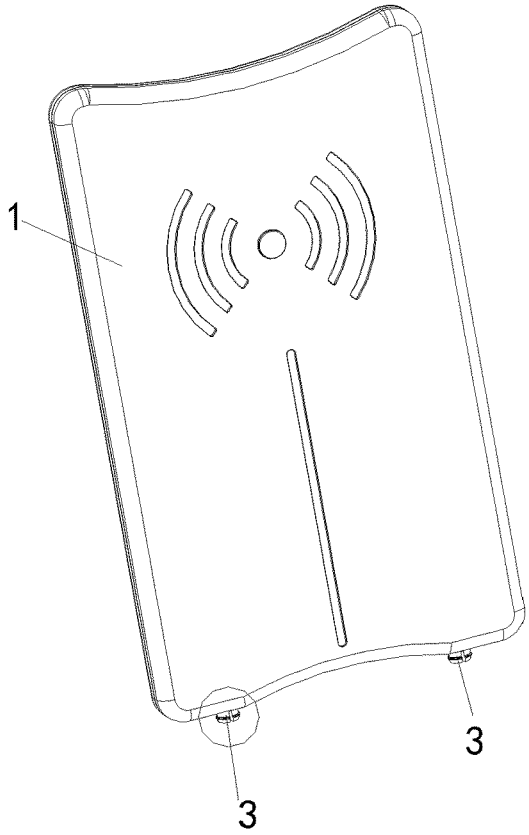
FIG. 8 is a structural schematic diagram of a casing of the home television antenna with the detachable bracket in the first embodiment of the present application.
Figure 9:
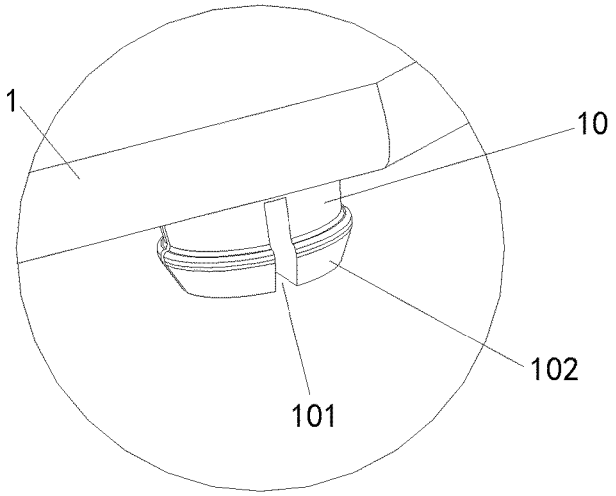
FIG. 9 is partial enlarged view of the structural schematic diagram of the casing of the home television antenna with the detachable bracket in the first embodiment of the present application.
Figure 10:
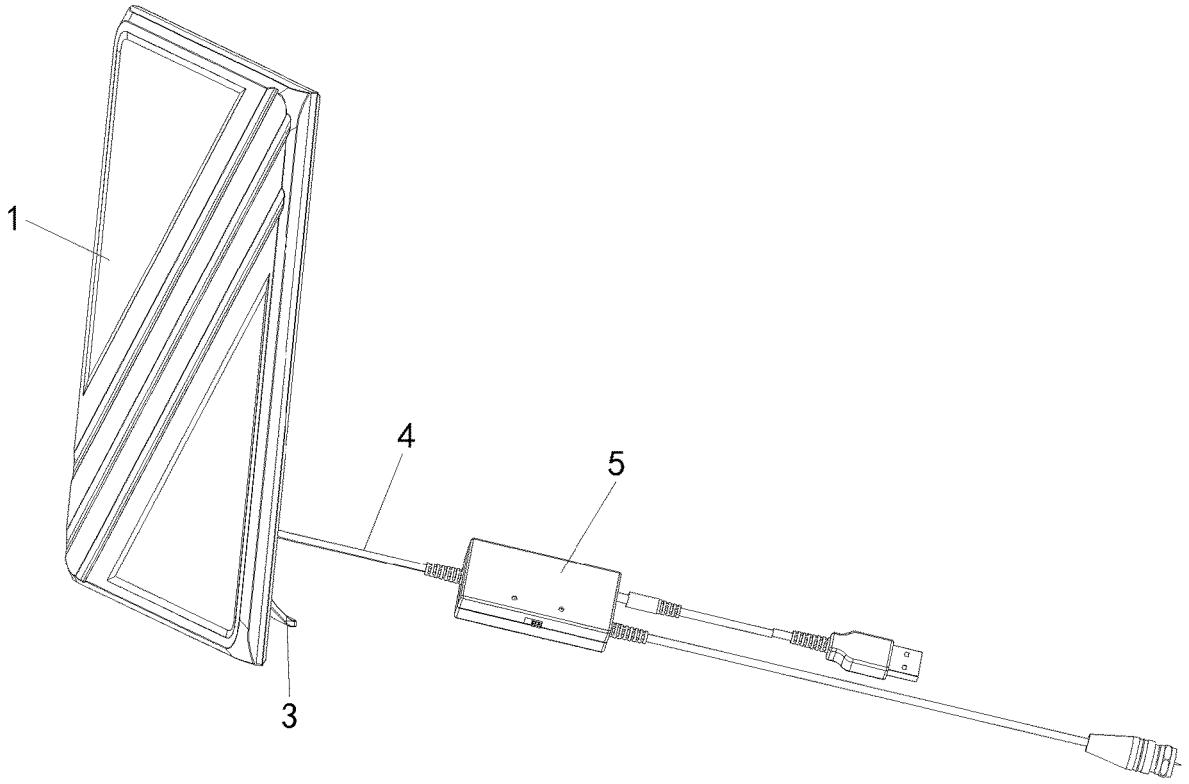
FIG. 10 is a first perspective structural schematic diagram of the home television antenna with the detachable bracket in the second embodiment of the present application.
Figure 11:
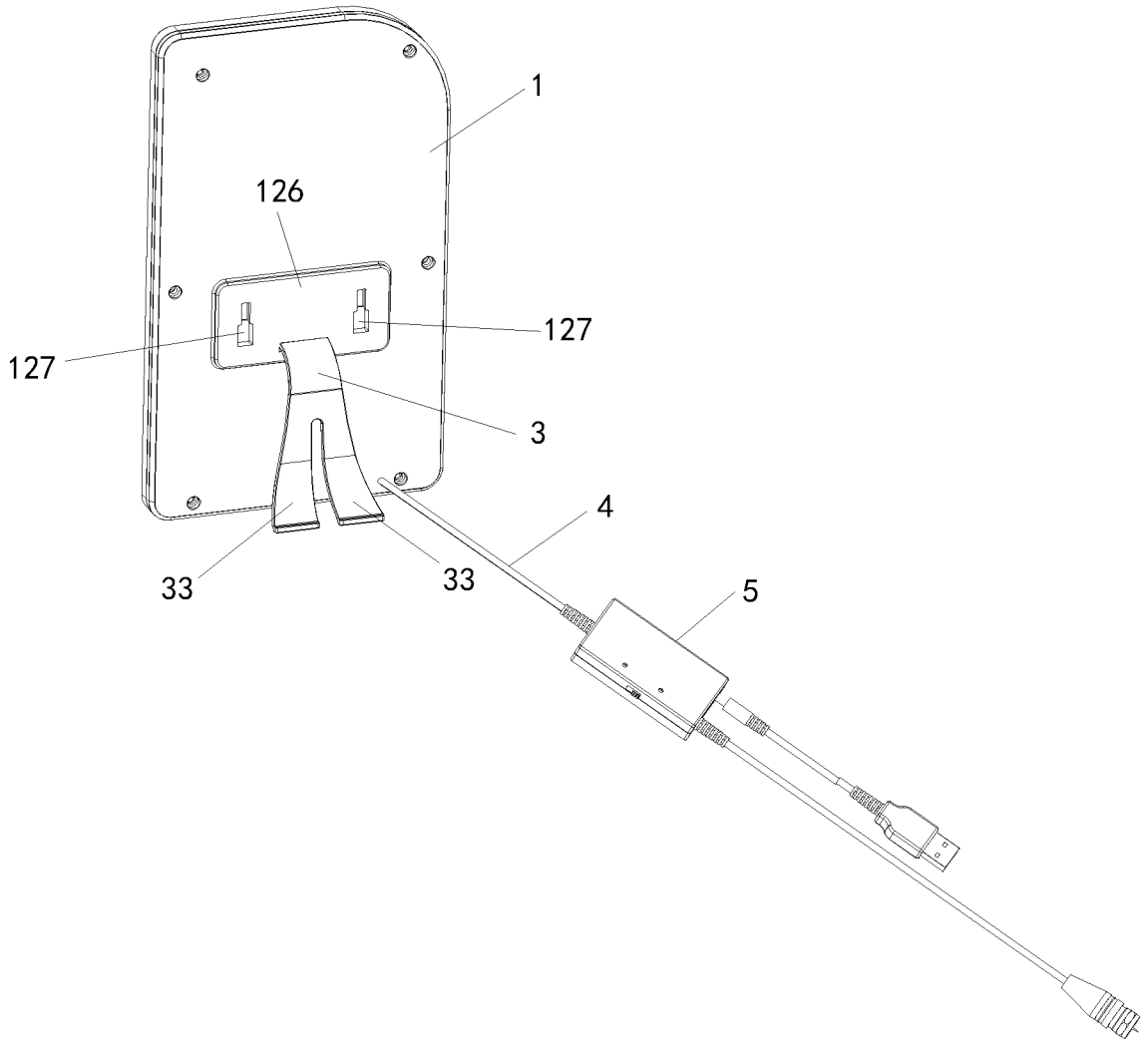
FIG. 11 is a second perspective structural schematic diagram of the home television antenna with the detachable bracket in the second embodiment of the present application.
Figure 12:
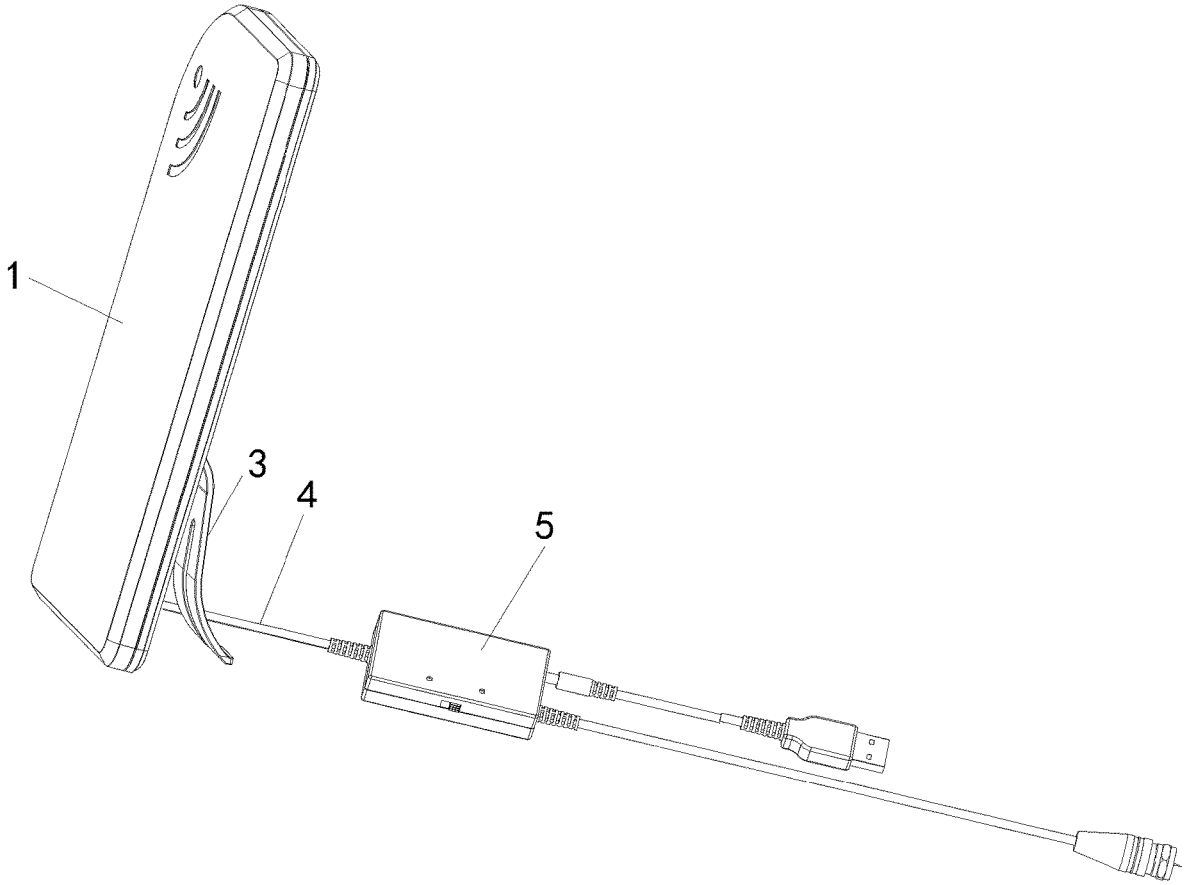
FIG. 12 is a first perspective structural schematic diagram of the home television antenna with the detachable bracket in the third embodiment of the present application.
Figure 13:
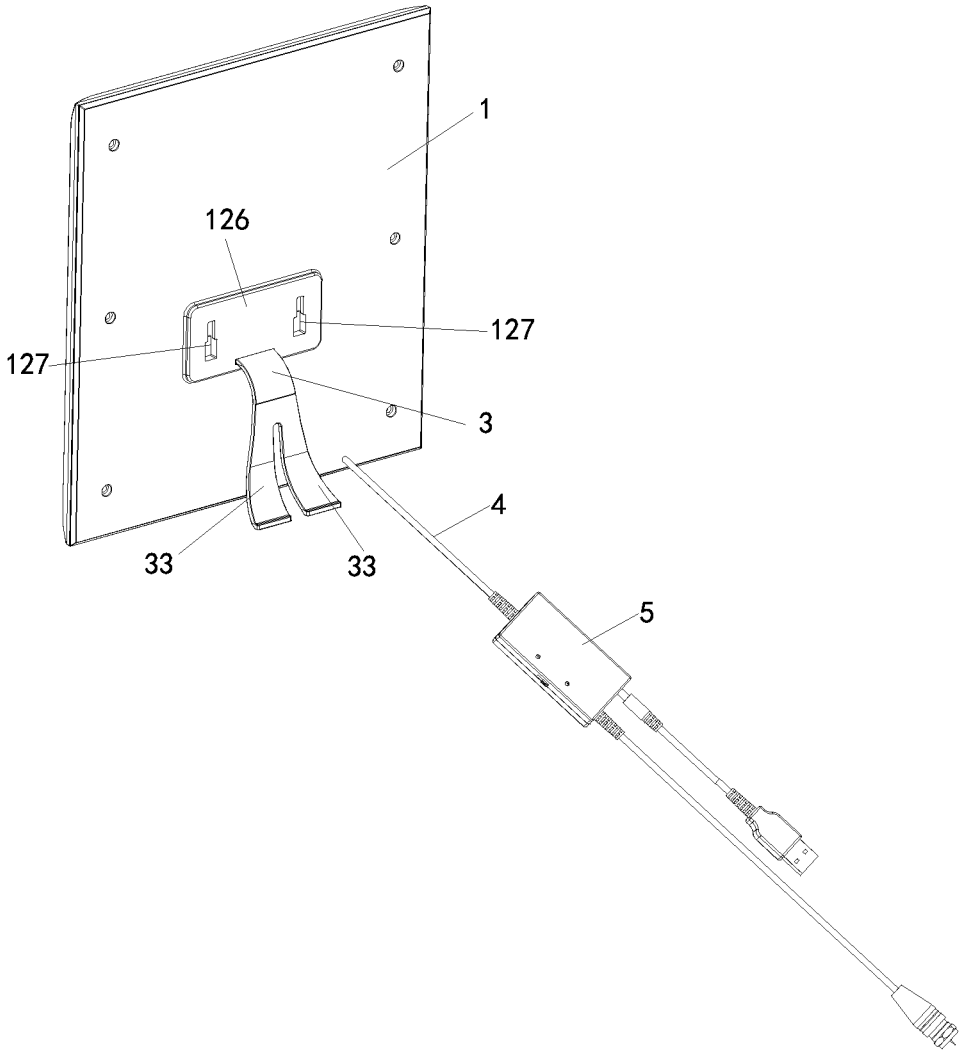
FIG. 13 is a second perspective structural schematic diagram of the home television antenna with the detachable bracket in the third embodiment of the present application.

Referring to FIG. 3, the lower part of the lower casing 12 is further provided with a wiring hole 123 and a wiring plate 124, the wiring plate 124 is located on one side of the wiring hole 123, the wiring plate 124 is perpendicular to the inner wall of the lower casing 12, and the wiring plate 124 is further provided with a wiring slot 125. In the present application, the transmission line 4 connected to the antenna mainboard 2 can be guided through the wiring slot 125 and then pass through the wiring hole 123 to the outside of the casing 1. The position of the transmission line 4 of the antenna mainboard 2 corresponds to the position of the wiring hole 123, as shown in FIGS. 2 and 6, and the transmission line 4 can also directly pass through the wiring hole 123 without the wiring slot 125.

Specifically, the outer wall of the lower casing 12 is further provided with a fixing member 126, and the fixing member 126 is provided with fixing clamp grooves 127. In the present application, the number of fixing clamp grooves 127 can be set to two, and the fixing clamp grooves are respectively formed on the left and right sides of the fixing member 126, and can also be fixed on the wall through the fixing clamp grooves 127 when necessary, and the application range is wider.

Figure 14:
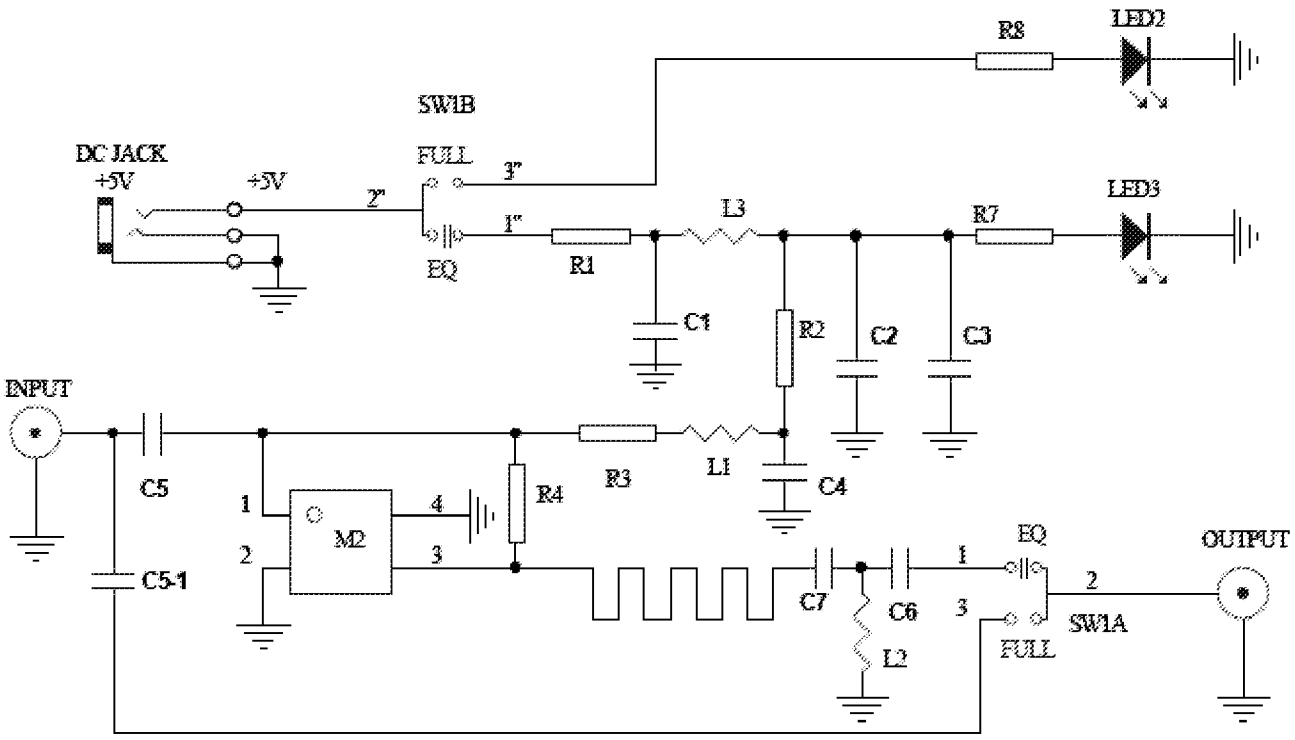
FIG. 14 is a circuit structural schematic diagram of a circuit module of the home television antenna with the detachable bracket in the present application.

Specifically, the home television antenna with the detachable bracket further comprises an antenna amplifying means 5 electrically connected to the transmission line 4; and, a circuit module is disposed in the antenna amplifying means 5; referring to FIG. 14, the circuit module comprises a power interface DC JACK, a power switch SW1B, a control switch SW1A, a control chip M2, a signal input terminal INPUT, a signal output terminal OUTPUT, a first capacitor C1, a second capacitor C2, a third capacitor C3, a fourth capacitor C4, a fifth capacitor C5, a sixth capacitor C5-1, a seventh capacitor C7, an eighth capacitor C6, a first resistor R8, a second resistor R1, a third resistor R2, a fourth resistor R7, a fifth resistor R3, a sixth resistor R4, a first inductor L3, a second inductor L1, a third inductor L2, a first light emitting diode LED2 and a second light emitting diode LED3, wherein the signal input terminal INPUT is electrically connected to the antenna mainboard 2 through the transmission line 4, the power switch SW1B and the control switch SW1A are both provided with EQ terminals and FULL terminals, the control chip M2 comprises four pins, the specific model number of the control chip M2 is Infineon BFP420;

The power interface DC JACK is connected to the input terminal of the power switch SW1B; when the power switch SW1B switches to the FULL terminal, one terminal of the first resistor R8 is connected to the power switch SW1B, and the other terminal of the first resistor R8 is connected to the anode of the first light emitting diode LED2, while the cathode of the first light emitting diode LED2 is grounded; in the present application, the circuit is connected to an external power supply through the power interface DC JACK, and after the +5V power supply is introduced into the circuit, if the power switch SW1B switches to the FULL terminal, the first light emitting diode LED2 is on and the circuit is in a neutral state at this time, which may protect the circuit, maintain its static function, prevent the circuit from working for a long time, and prolong the lifetime of the circuit;

When the power switch SW1B switches to the EQ terminal, one terminal of the second resistor R1 is connected to the power switch SW1B, and the other terminal of the second resistor R1 is connected to one terminal of the first inductor L3, and the other terminal of the first inductor L3 is connected to one terminal of the fourth resistor R7, while the other terminal of the fourth resistor R7 is connected to the anode of the second light emitting diode LED3, and the cathode of the second light emitting diode is grounded; and, one terminal of the first capacitor C1 is connected to the common terminal of the second resistor R1 and the first inductor L3, the other terminal of the first capacitor C1 is grounded, one terminal of the second capacitor C2 and one terminal of the third capacitor C3 are both connected to the common terminal of the first inductor L3 and the fourth resistor R7, and the other terminals of the second capacitor C2 and the third capacitor C3 are both grounded; in the present application, if the power switch SW1B switches to the EQ terminal, the +5V power supply passes through the second resistor R1, the first inductor L3, and the fourth resistor R7, and then the second light emitting diode LED3 is on, during which the first capacitor C1, the second capacitor C2, and the third capacitor C3 act as a filter to ensure the safe grounding of the circuit;

One terminal of the third resistor R2 is connected to the common terminal of the first inductor L3 and the fourth resistor R7, the other terminal of the third resistor R2 is connected to one terminal of the second inductor L1, the other terminal of the second inductor L1 is connected to one terminal of the fifth resistor R3, the other terminal of the fifth resistor R3 is connected to a first pin of the control chip M2, one terminal of the sixth resistor R4 is connected to the common terminal of the fifth resistor R3 and the control chip M2, the other terminal of the sixth resistor R4 is connected to a third pin of the control chip M2, one terminal of the fourth capacitor C4 is connected to the common end of the third resistor R2 and the second inductor L1, and the other terminal of the fourth capacitor C4 is grounded; and, a second pin and a fourth pin of the control chip M2 are both grounded; in the present application, the power switch SW1B switches to the EQ terminal, and the +5V power supply passes through the third resistor R2, the second inductor L1, and the fifth resistor R3, and then achieves the first pin of the control chip M2, and the +5V power supply simultaneously passes through the third resistor R2, the second inductor L1, the fifth resistor R3 and the sixth resistor R4, and then achieves the third pin of the control chip M2;

One terminal of the fifth capacitor C5 is connected to the first pin of the control chip M2, the other terminal of the fifth capacitor C5 is connected to the signal input terminal INPUT, the signal input terminal INPUT is further connected with one terminal of the sixth capacitor C5-1, and the other terminal of the sixth capacitor C5-1 is connected to the FULL terminal of the control switch SW1A, and the signal output terminal OUTPUT is connected to the control switch SW1A; in the present application, when the power switch SW1B switches to the EQ terminal, if the control switch SW1A switches to the FULL terminal, a television signal input from the signal input terminal INPUT is filtered by the six capacitor C5-1 and flows to the signal output terminal OUTPUT which directly outputs the television signal to the television;

The third pin of the control chip M2 is connected to one terminal of the seventh capacitor C7, the other terminal of the seventh capacitor C7 is connected to one terminal of the eighth capacitor C6, and the other terminal of the eighth capacitor C6 is connected to the EQ terminal of the control switch SW1A; and, one terminal of the third inductor L2 is connected to the common terminal of the seventh capacitor C7 and the eighth capacitor C6, and the other terminal of the third inductor L2 is grounded; in the present application, when the power switch SW1B switches to the EQ terminal, if the control switch SW1A switches to the EQ terminal, the television signal input from the signal input terminal INPUT is amplified by the control chip M2, and then filtered by a filter circuit consists of the seventh capacitor C7, the third inductor L2 and the eighth capacitor C6, after which it is output to the signal output terminal OUTPUT.

In the present application, through the setting of the above circuit structure, a user can conveniently select to amplify or not amplify the television signal according to the distance between the home and a base station from which the television signal is transmitted or the strength of the television signal. Firstly, it is needed to switch the power switch SW1B to the EQ terminal to connect the control chip M2 to the power supply. When the television signal is strong, the control switch SW1A may be placed on the FULL side, and the television signal can be input stably and normally for television playback without amplification. When the television signal is weak, the control switch SW1A may be placed on the EQ side, and the television signal received by the antenna mainboard 2 is amplified by the control chip M2 and output from the signal output terminal OUTPUT, and then the television signal can be normally play. The user can flexibly choose according to his/her own condition. Compared with the technical solutions in the prior art that the signals are equally processed regardless of the signal strength, in the present application, with the settings of distinguishing the strength of the television signal wherein the stronger television signal is directly output and the weaker television signal is amplified before output, it is more reliable while the damage to the television itself is smaller, and the television signal is better.

The present application has the advantageous effects in that: compared with the prior art, in the present application, the home television antenna can be supported and placed on the desktop by the setting of the bracket structure, so as to avoid affecting the signal transmission while being hung on the wall, and the television antenna can be conveniently placed on any plane without construction on the wall for fixing the television antenna; and, the detachable connection between the bracket and the casing facilitates installation and disassembly, and it's convenient for transportation as the volume is reduced after the disassembly and it is convenient to install when the use is needed. The bracket and the casing can be separately produced, thus reducing the processing difficulty. The above embodiments are only the preferred embodiments of the present application and are not intended to limit the present application. Any modifications, equivalent substitutions and improvements which are made within the spirit and principle of the present application should be included in the protection scope of the present application.

What is claimed is:

1. A home television antenna with a detachable bracket, comprising a casing and an antenna mainboard, wherein the home television antenna further comprises a bracket for supporting the casing, the antenna mainboard is disposed inside the casing and connected to a transmission line, the transmission line extends to the exterior of the casing, and the bracket is detachably connected to the casing;

wherein the casing comprises an upper casing and a lower casing, the upper casing and the lower casing are fixedly connected and enclose to form a limiting space;

wherein the antenna mainboard is provided with first screw holes, first limiting posts are provided on locations inside the lower casing and opposite to the first screw holes; and, the lower casing is provided with second screw holes, second limiting posts are provided on locations inside the upper casing and opposite to the second screw holes, and each of the first limiting posts and the second limiting posts is provided with a thread groove.

2. The home television antenna with the detachable bracket according to claim 1, wherein the bracket is detachably connected to the bottom of the casing, the top of the bracket is provided with fixing holes, the bottom of the casing is provided with fixing posts adapted to the fixing holes, the center part of the fixing post has a through groove, the bottom of the fixing post is provided with a fixing head, and the end of the fixing head connecting to the fixing post is larger than the other end of the fixing head.

3. The home television antenna with the detachable bracket according to claim 1, wherein the number of the first screw holes and the number of the first fixing posts are both four, the number of the second screw holes and the number of the second fixing posts are both six, the six second screw holes are respectively formed on two sides of upper part, two sides of middle part and two sides of lower part of the lower casing, and the second screw holes on two sides of the lower casing are symmetrically arranged, and the six second fixing posts are respectively integrally formed on two sides of upper part, two sides of middle part and two sides of lower part of a surface of the upper casing facing the lower casing, the second fixing posts on two sides of the upper casing correspond to the second screw holes in terms of positions and are symmetrically arranged with each other, the four first screw holes are respectively provided on two sides of upper part and two sides of lower part of the antenna mainboard, and the first screw holes on the two sides of the antenna mainboard are symmetrically arranged with respect to each other, the four first fixing posts correspond to the first screw holes in terms of positions and are between the second screw holes on the upper part and the lower part of the lower casing; and, two sides of middle part of the antenna mainboard are further provided with third screw holes corresponding to the positions of the second screw holes on two sides of the middle part of the lower casing.

4. The home television antenna with the detachable bracket according to claim 1, wherein the lower part of the lower casing is further provided with a wiring hole and a wiring plate, the wiring plate is located on one side of the wiring hole, the wiring plate is perpendicular to the inner wall of the lower casing, and the wiring plate is further provided with a wiring slot; and, the outer wall of the lower casing is further provided with a fixing member, and the fixing member is provided with fixing clamp grooves.

5. The home television antenna with the detachable bracket according to claim 1, wherein the home television antenna with the detachable bracket further comprises an antenna amplifying means electrically connected to the transmission line; and, a circuit module is disposed in the antenna amplifying means; the circuit module comprises a power interface, a power switch, a control switch, a control chip, a signal input terminal, a signal output terminal, a first capacitor, a second capacitor, a third capacitor, a fourth capacitor, a fifth capacitor, a sixth capacitor, a seventh capacitor, an eighth capacitor, a first resistor, a second resistor, a third resistor, a fourth resistor, a fifth resistor, a sixth resistor, a first inductor, a second inductor, a third inductor, a first light emitting diode and a second light emitting diode, wherein the signal input terminal is electrically connected to the antenna mainboard through the transmission line, the power switch and the control switch are both provided with EQ terminals and FULL terminals, the control chip comprises four pins, the specific model number of the control chip is Infineon BFP420;

the power interface is connected to the input terminal of the power switch; when the power switch switches to the FULL terminal, one terminal of the first resistor is connected to the power switch, and the other terminal of the first resistor is connected to the anode of the first light emitting diode, while the cathode of the first light emitting diode is grounded;

when the power switch switches to the EQ terminal, one terminal of the second resistor is connected to the power switch, and the other terminal of the second resistor is connected to one terminal of the first inductor, and the other terminal of the first inductor is connected to one terminal of the fourth resistor, while the other terminal of the fourth resistor is connected to the anode of the second light emitting diode, and the cathode of the second light emitting diode is grounded; and, one terminal of the first capacitor is connected to the common terminal of the second resistor and the first inductor, the other terminal of the first capacitor is grounded, one terminal of the second capacitor and one terminal of the third capacitor are both connected to the common terminal of the first inductor and the fourth resistor, and the other terminals of the second capacitor and the third capacitor are both grounded;

one terminal of the third resistor is connected to the common terminal of the first inductor and the fourth resistor, the other terminal of the third resistor is connected to one terminal of the second inductor, the other terminal of the second inductor is connected to one terminal of the fifth resistor, the other terminal of the fifth resistor is connected to a first pin of the control chip, one terminal of the sixth resistor is connected to the common terminal of the fifth resistor and the control chip, the other terminal of the sixth resistor is connected to a third pin of the control chip, one terminal of the fourth capacitor is connected to the common end of the third resistor and the second inductor, and the other terminal of the fourth capacitor is grounded; and, a second pin and a fourth pin of the control chip are both grounded;

one terminal of the fifth capacitor is connected to the first pin of the control chip, the other terminal of the fifth capacitor is connected to the signal input terminal, the signal input terminal is further connected with one terminal of the sixth capacitor, and the other terminal of the sixth capacitor is connected to the FULL terminal of the control switch, and the signal output terminal is connected to the control switch;

the third pin of the control chip is connected to one terminal of the seventh capacitor, the other terminal of the seventh capacitor is connected to one terminal of the eighth capacitor, and the other terminal of the eighth capacitor is connected to the EQ terminal of the control switch; and, one terminal of the third inductor is connected to the common terminal of the seventh capacitor and the eighth capacitor, and the other terminal of the third inductor is grounded.

6. A home television antenna with a detachable bracket, comprising a casing and an antenna mainboard, wherein the home television antenna further comprises a bracket for supporting the casing, the antenna mainboard is disposed inside the casing and connected to a transmission line, the transmission line extends to the exterior of the casing, and the bracket is detachably connected to the, wherein the bracket is detachably connected to one side of the casing, a fixed angle is formed between the bracket and the casing so as to support the casing, the upper part of the bracket is provided with a fixing clamp plate, the side of the casing is provided with a limiting groove adapted to the fixing clamp plate, the lower part of the bracket extends to form branch portions on two sides, a spacing is formed between the branch portions on both sides of the lower parts of the bracket, and the width of the branch portions on both sides of the lower part of the bracket gradually increases from top to bottom; and the upper part and the lower part of the bracket are both arc-shaped structures, bend directions of the upper part and the lower part of the bracket are opposite to each other, and the angle between the bracket and the casing is an acute angle.

7. A home television antenna with a detachable bracket, comprising a casing and an antenna mainboard, wherein the home television antenna further comprises a bracket for supporting the casing, the antenna mainboard is disposed inside the casing and connected to a transmission line, the transmission line extends to the exterior of the casing, and the bracket is detachably connected to the casing;

wherein the casing comprises an upper casing and a lower casing, the upper casing and the lower casing are fixedly connected and enclose to form a limiting space;

wherein horizontal positioning plates and vertical positioning plates are both disposed inside the upper casing and the lower casing, the horizontal positioning plates and the vertical positioning plates are placed cross each other to form a grid structure, and the horizontal positioning plates and the vertical positioning plates of the upper casing correspond to the horizontal positioning plates and the vertical positioning plates of the lower casing in terms of positions and enclose to form the limiting space.

8. The home television antenna with the detachable bracket according to claim 7, wherein the number of the horizontal positioning plates of the upper casing and the number of the horizontal positioning plates of the lower casing are both more than three, the number of the vertical positioning plates of the upper casing and the number of the vertical positioning plates of the lower casing are both more than three, the more than three horizontal positioning plates of the upper casing and the lower casing have equal spacing among each other, the more than three vertical positioning plates of the upper casing and the lower casing have equal spacing among each other, three horizontal positioning plates in the upper casing and the lower casing are respectively horizontally provided in the upper end, middle end and lower end inside the upper casing and the lower casing, and, three vertical positioning plates in the upper casing and the lower casing are respectively vertically provided in the left end, middle end and right end inside the upper casing and the lower casing.

* * * * *